US005386795A

United States Patent [19]

Bartholomew

[11] Patent Number: 5,386,795

[45] Date of Patent: Feb. 7, 1995

[54] COMBINATION PILL BOTTLE CAP AND INDICATOR DEVICE

[75] Inventor: Donald D. Bartholomew, Mt. Clemens, Mich.

[73] Assignee: Proprietary Technology, Inc., Clinton Township, Macomb County, Mich.

[21] Appl. No.: 179,877

[22] Filed: Jan. 11, 1994

Related U.S. Application Data

[63] Continuation of Ser. No. 13,439, Feb. 4, 1993, abandoned, which is a continuation of Ser. No. 733,345, Jul. 22, 1991, Pat. No. 5,216,975.

[51] Int. Cl.[6] ..... G09F 9/40

[52] U.S. Cl. ..... 116/308; 116/311; 116/315; 116/324

[58] Field of Search ..... 116/308, 309, 315, 311, 116/312, 321, 323, 324

[56] References Cited

U.S. PATENT DOCUMENTS

| | | | |
|---|---|---|---|
| 493,851 | 3/1893 | Adsit | 116/307 |
| 617,952 | 1/1899 | Burton | 116/308 |
| 2,450,949 | 10/1948 | Gattuccio et al. | 116/308 |
| 2,587,147 | 2/1952 | Guion et al. | 116/308 |
| 2,767,680 | 10/1956 | Lermer | 116/308 |
| 2,817,451 | 12/1957 | Giles et al. | 116/308 X |
| 3,404,657 | 10/1968 | Zmuda | 116/309 |
| 3,739,740 | 6/1973 | Fromer | 116/308 |
| 3,921,568 | 11/1975 | Fish | 116/308 |
| 4,011,829 | 3/1977 | Wachsmann et al. | 116/308 |
| 4,345,541 | 8/1982 | Villa-Real | 116/308 |
| 4,365,722 | 12/1982 | Kramer | 215/220 |
| 4,405,045 | 9/1983 | Villa-Real | 206/534 |
| 4,729,472 | 3/1988 | Lubin et al. | 116/308 X |
| 4,920,912 | 5/1990 | Kirkling | 116/308 |
| 4,951,596 | 8/1990 | Wallace, Jr. | 116/321 |
| 5,011,032 | 4/1991 | Rollman | 215/230 |

*Primary Examiner*—William A. Cuchlinski, Jr.
*Assistant Examiner*—John L. Beres
*Attorney, Agent, or Firm*—Harness, Dickey & Pierce

[57] ABSTRACT

A combination pill bottle cap and indicator device adapted to function as the closure or cover for a pill bottle or container. The device includes an indicator providing a visual indication for the user that a pill has been or should be removed from the bottle for consumption.

8 Claims, 2 Drawing Sheets

COMBINATION PILL BOTTLE CAP AND INDICATOR DEVICE

This application is a continuation of U.S. patent application Ser. No. 013,439 filed Feb. 4, 1993, now abandoned, which is a continuation of U.S. patent application Ser. No. 733,345 filed Jul. 22, 1991, now issued as U.S. Pat. No. 5,216,975.

BACKGROUND OF THE INVENTION

Pill holding bottles have been used for many years. The caps or closures of these bottles are attached to the bottle by many means, among which is threads.

It is desirable to have an indicator on the cap, or shoulder of the bottle that is for the purpose of indicating if a pill taker has taken or not taken a pill or pills, or tablets, or capsules, etc.

The indicator may indicate many pill takings, or only one pill taking.

The indicator may be adapted to any type of cap or bottle, the only requirement is that the indicator is movable to a new position, and that it is detented by some means to any position that it is moved from or to.

The indicator may conceal an indication from view, or alternatively expose the indication to view.

The desirability of having an indicator for pill bottles appears to be real. A special non-pill bottle package for birth control pills is in effect—an entire package which is an indicator, having a dose in each compartment of the indicator package. This birth control pill package is constructed as one large indicator.

Once the idea of how this indicator might be included at a cost consistent with the cost of packaging pills in bottles, then the approaches that are to be found in the figures in the disclosures became apparent.

There are no indicators added to pill bottle caps, or bottles for that matter, in production today, in spite of pill bottles and caps being in use for years. The need and market acceptability has existed for as many years, so the conclusion must be that no one in that business has found a way to include an indicator at a cost which would be "digested" by the marketplace.

In operation one takes a pill, etc., moves the indicator to a position that corresponds (for that person) to having taken that pill, etc., and the indicator acts as a reminder that, that particular pill, etc., has been taken.

At the simplest, one can include an indicator with only one additional inexpensive part that snaps into, or onto, a part that is already needed and has been altered to accept this part.

OBJECTS OF THE INVENTION

The object of the present invention, therefore, is provide an indicator on a pill, etc., bottle which will be of sufficiently low cost that it will be acceptable in the marketplace, and if the indicator is designed so as to use a part of the cap or bottle to receive the part or parts required for the indicator, that the cost of providing an indicator can be minimized to a point where the cost is acceptable in the marketplace.

DESCRIPTION OF THE PREFERRED EMBODIMENTS

Figure 1A:
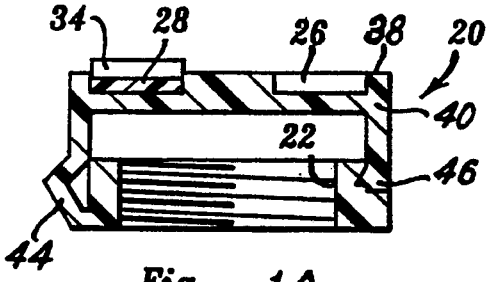
FIG. 1A is a vertical cross sectional view of the cap shown in FIG. 1 taken in the direction of arrows 1A—1A of FIG. 1.

Referring to FIGS. 1, 2, 4 and 5, the total pill bottle assembly 10 and 10' consists of a bottle 12 and 12', a neck portion 14 and 14' that receives cap assembly 20 and 20'. Cap assembly 20 and 20' is a hollow cylindrical member which includes a portion 22 and 22' which is adapted to connect cap 20 and 20' to area 14 and 14' of bottle 12 and 12', and a closed end 40 of cap 20 and 20' including an annular wall 38 which will receive the moving portion of the indicator 28 and 28'. The interior surface of portion 22 and 22' may be threaded to mate with a thread 42 and 42' on area 14 and 14' or portion 22 and 22' may be attached to area 14 and 14' by other means known well in the art. Cap 20 and 20' define an annular cavity 26 and 26' which will receive an indicator portion 28 and 28', or alternatively annular cavity 26 and 26' can receive a part (not shown) with the numbers of letters on it, which will act with the moving additional indicator portion 28 and 28'.

Figure 2:
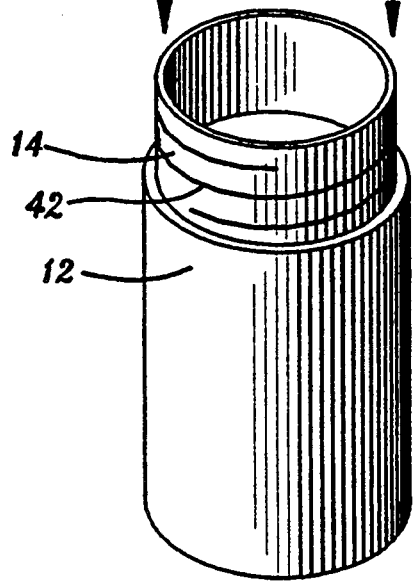
FIG. 2 shows the indicator as part of the pill bottle cap in a linear configuration.
Figure 2:
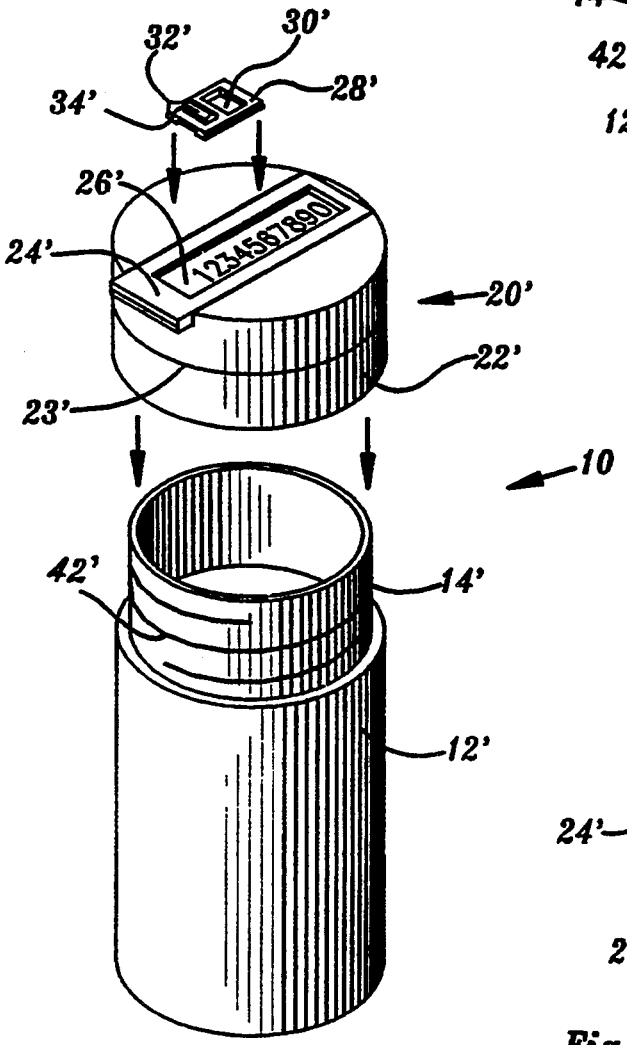
Figure 5:
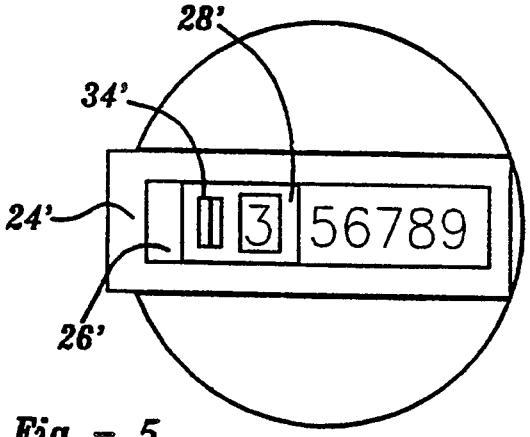
FIG. 5 is a top view of the pill bottle of FIG. 2.

Moving part 28 and 28' is snapped into annular cavity 26 and 26' the surrounding circular boss 29 and has a detent means 32 and 32' integrally contained on said annular movable member which cooperates with cap 20 or 20'. The moving part 28' of FIGS. 2 and 5 is sized to fit securely within area 26' such that it is retained by the side walls of area 26' and is slidable along the linear path provided by area 26'. The detent means includes a circumferential projection member extending from the annular moveable member and a receiving groove in the annular wall. Moving part 28 and 28' may also include a means 34 and 34' to facilitate the movement of part 28 and 28' by an outside agency such as a finger of an individual. Moving part 28 and 28' may also include a window 30 and 30', through which numbers, letters, or other markings are viewed.

Figure 1:
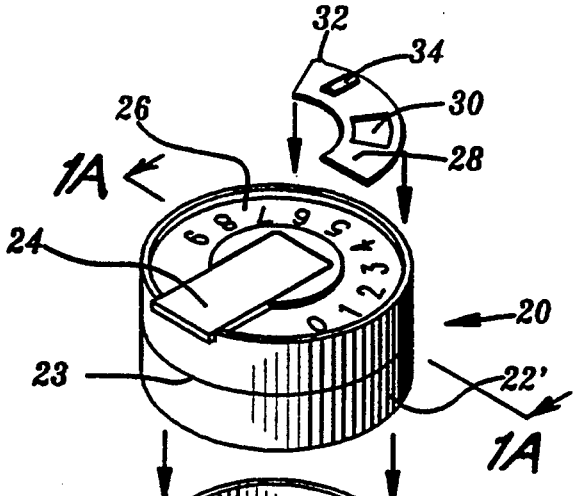
FIG. 1 shows the indicator as part of the pill bottle cap in a circular configuration.

In FIGS. 1 and 2 are also shown 23 and 23'. 23 and 23' is a separation of part 22 and 22', which is attached to the neck 14 and 14' of the bottle 12 and 12', such that the non-bottle attached portion of cap 20 and 20' is attached to portion 22 and 22' by means of a hinge 44 or some other means, and includes means 46 for closing the cap 20 and 20'. These means are shown in FIG. 1A.

Figure 3:
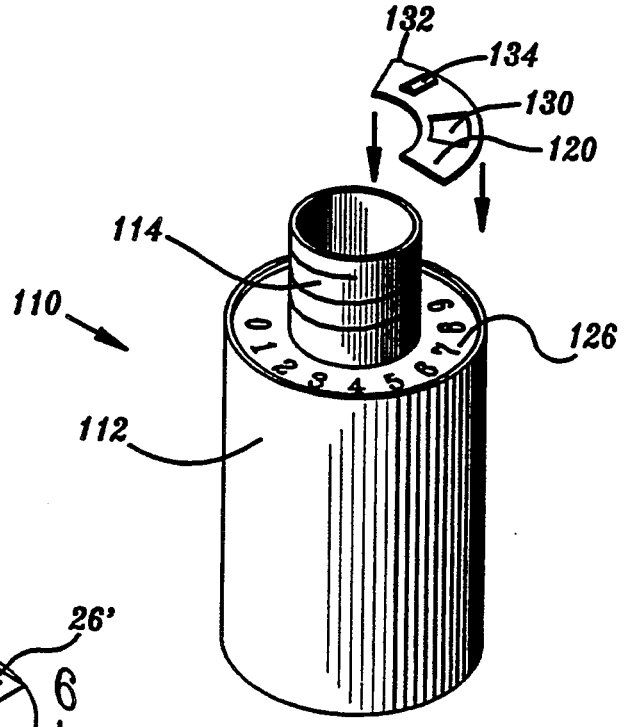
FIG. 3 shows the indicator as part of the pill bottle.
Figure 4:
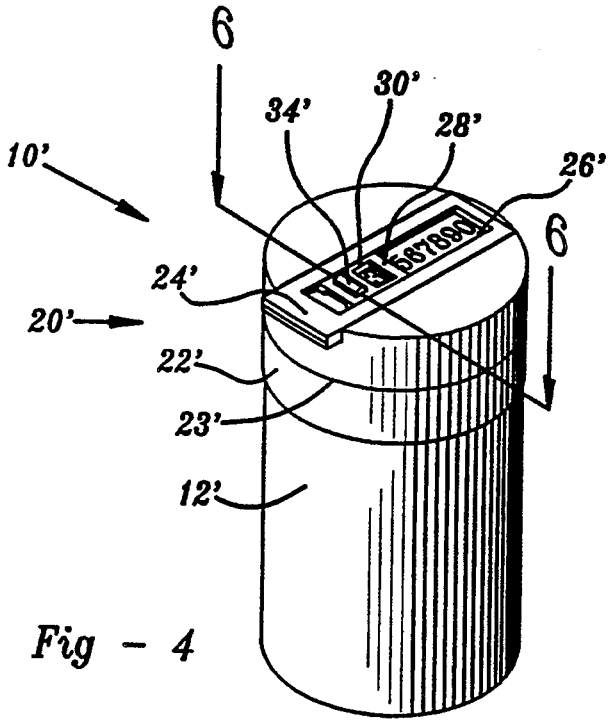
FIG. 4 shows the pill bottle cap of FIG. 2 attached to the pill bottle.
Figure 6:
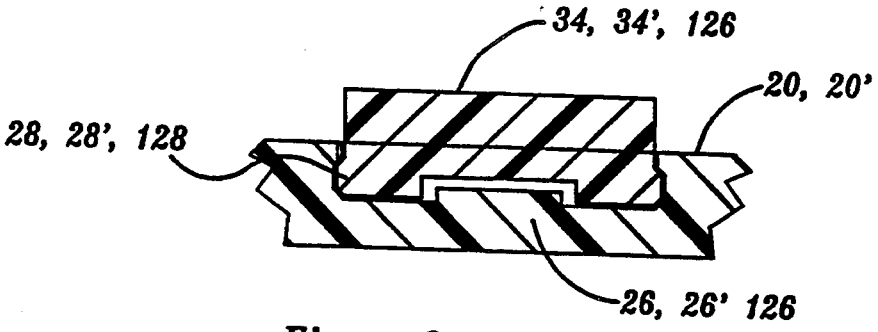
FIG. 6 is a sectional view looking at the indicator perpendicular to a plane defined by arrows 6—6 in FIG. 4.

Turning to FIG. 3, only the bottle 112 and the indicator 128 are shown as 110. The shoulder area of bottle 112 below the cap has been adapted to receive indicator part 128.

The explanation of 26 and 26' of the FIGS. 1 and 2, applies to area 126, and the explanations for 30 and 30', 32 and 32', and 34 and 34' relate to 130, 132, and 134 similarly.

FIGS. 1, 2, and 3 show embodiments of a method of including an indicator on either the cap or bottle, of a pill bottle. The method shown only requires a change in the cap or bottle to receive a moving part and the addition of detent and marking. These parts will then preform as an indicator, that is changed (operated) at the time of taking a pill, etc., to become an indication that the pill, etc., has been taken, or should be taken.

Included are the situations where a second part which includes some or all of the indicator information may also be added, if that information is not included when the bottle or cap is manufactured.

The indicator information has been shown as part of the moving part receiving area, but it is also recognized that this information could have been included outside the moving part receiving area.

The patent thus shows that by using the method shown, an indicator for a pill bottle may be incorporated at very low cost, the lowest cost being achieved when only one low cost part is added to an altered cap or bottle.

What is claimed is:

1. A cap for a bottle used for containing pharmaceutical products such as pills, tablets or the like, said cap comprising a first hollow cylindrical member having a closed end and an open end;

an annular wall and a circular boss extending from said closed end of said first hollow cylindrical member, said closed end, said circular boss and said annular wall defining an annular cavity;

a plurality of indicia disposed on said closed end and within said annular cavity of said first hollow cylindrical member;

an annular movable member disposed within said annular cavity and movable within said annular cavity for selecting one of said plurality of indicia to indicate that said pharmaceutical product has been or should be taken.

2. The cap of claim 1 wherein said movable member moves in a non-linear manner.

3. The cap of claim 1 wherein said movable member has a window.

4. The cap of claim 1 wherein said movable member includes means for assisting an outside agency to move said movable member.

5. The cap of claim 1 wherein said movable member includes detent means for retaining said movable member in a specified position.

6. The cap of claim 1 further comprising a second hollow cylindrical member hingedly secured to said first hollow cylindrical member and extending from said open end of said first hollow cylindrical member, said second hollow cylindrical member being adapted to mate with said bottle such that access to the interior of said bottle is obtained by pivoting said first hollow cylindrical member on said hinge.

7. A cap for a bottle used for containing pharmaceutical products such as pills, tablets or the like, said cap comprising a first hollow cylindrical member having a closed end and an open end;

an annular wall and a circular boss extending from said closed end of said first hollow cylindrical member, said closed end, circular boss and said annular wall defining an annular cavity;

a plurality of indicia disposed on said closed end and within said annular cavity of said first hollow cylindrical member;

an annular movable member disposed within said annular cavity and movable within said annular cavity for selecting one of said plurality of indicia to indicate that said pharmaceutical product has been or should be taken; and detent means for movably coupling said annular movable member with said annular wall.

8. The invention as set forth in claim 7 wherein said detent means is integrally contained on said annular movable member.

* * * * *